US008342268B2

(12) United States Patent
Lockstedt et al.

(10) Patent No.: US 8,342,268 B2
(45) **Date of Patent: *Jan. 1, 2013**

(54) TOUGH CARBIDE BODIES USING ENCAPSULATED CARBIDES

(75) Inventors: Alan W. Lockstedt, Magnolia, TX (US); Gregory T. Lockwood, Pearland, TX (US)

(73) Assignee: Smith International, Inc., Houston, TX (US)

( * ) Notice: Subject to any disclaimer, the term of this patent is extended or adjusted under 35 U.S.C. 154(b) by 493 days.

This patent is subject to a terminal disclaimer.

(21) Appl. No.: 12/539,412

(22) Filed: Aug. 11, 2009

(65) Prior Publication Data

US 2010/0038147 A1 Feb. 18, 2010

Related U.S. Application Data

(60) Provisional application No. 61/088,077, filed on Aug. 12, 2008.

(51) Int. Cl.
*E21B 10/46* (2006.01)

(52) U.S. Cl. ..... 175/374; 175/435

(58) Field of Classification Search ..... 175/374, 175/425, 434
See application file for complete search history.

(56) References Cited

U.S. PATENT DOCUMENTS

| | | | | |
|---|---|---|---|---|
| 3,379,503 | A | 4/1968 | McKenna | |
| 4,723,996 | A | 2/1988 | Brunet et al. | |
| 4,834,963 | A | 5/1989 | Terry et al. | |
| 5,089,182 | A | 2/1992 | Findeisen et al. | |
| 5,541,006 | A | 7/1996 | Conley | |
| 5,988,302 | A * | 11/1999 | Sreshta et al. | 175/374 |
| 6,287,360 | B1 | 9/2001 | Kembaiyan et al. | |
| 6,908,688 | B1 | 6/2005 | Majagi et al. | |
| 7,810,588 | B2 * | 10/2010 | McClain et al. | 175/434 |
| 2006/0081402 | A1 * | 4/2006 | Lockwood et al. | 175/374 |
| 2009/0260893 | A1 * | 10/2009 | Sheng et al. | 175/426 |

* cited by examiner

*Primary Examiner* — William P Neuder
(74) *Attorney, Agent, or Firm* — Osha Liang LLP

(57) ABSTRACT

A drill bit that includes a bit body having a plurality of blades extending radially therefrom, wherein at least a portion of the bit body comprises a first matrix region comprising a plurality of primary carbide particles having an average mean free path of at least about 10 microns; and at least one cutting element for engaging a formation disposed on at least one of the plurality of blades is disclosed.

22 Claims, 5 Drawing Sheets

TOUGH CARBIDE BODIES USING ENCAPSULATED CARBIDES

CROSS-REFERENCE TO RELATED APPLICATIONS

This application claims priority, under 35 U.S.C.§119(e), to U.S. Patent Application No. 61/088,077, filed on Aug. 12, 2008, the content of which is herein incorporated by reference in its entirety.

BACKGROUND OF INVENTION

1. Field of the Invention

Embodiments disclosed herein relate generally to carbide bodies forming drill bits and other cutting or drilling tools or downhole components.

2. Background Art

Polycrystalline diamond compact ("PDC") cutters are known in the art for use in earth-boring drill bits. Typically, bits using PDC cutters include an integral bit body which may be made of steel or fabricated from a hard matrix material such as tungsten carbide (WC). A plurality of PDC cutters is mounted along the exterior face of the bit body in extensions of the bit body called "blades." Each PDC cutter has a portion which typically is brazed in a recess or pocket formed in the blade on the exterior face of the bit body.

The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

While steel body bits may have toughness and ductility properties which make them resistant to cracking and failure due to impact forces generated during drilling, steel is more susceptible to erosive wear caused by high-velocity drilling fluids and formation fluids which carry abrasive particles, such as sand, rock cuttings, and the like. Generally, steel body PDC bits are coated with a more erosion-resistant material, such as tungsten carbide, to improve their erosion resistance. However, tungsten carbide and other erosion-resistant materials are relatively brittle. During use, a thin coating of the erosion-resistant material may crack, peel off or wear, exposing the softer steel body which is then rapidly eroded. This can lead to loss of PDC cutters as the area around the cutter is eroded away, causing the bit to fail.

Tungsten carbide or other hard metal matrix body bits have the advantage of higher wear and erosion resistance as compared to steel bit bodies. The matrix bit generally is formed by packing a graphite mold with tungsten carbide powder and then infiltrating the powder with a molten copper-based alloy binder. There are several types of tungsten carbide that have been used in forming matrix bodies, including macrocrystalline tungsten carbide, cast tungsten carbide, carburized (or agglomerated) tungsten carbide, and cemented tungsten carbide. Macrocrystalline tungsten carbide is essentially stoichiometric WC which is, for the most part, in the form of single crystals; however, some large crystals of macro-crystalline WC are bi-crystals. Carburized tungsten carbide has a multi-crystalline structure, i.e., they are composed of WC agglomerates.

Cast tungsten carbide, on the other hand, is formed by melting tungsten metal (W) and tungsten monocarbide (WC) together such that a eutectic composition of WC and $W_2C$, or a continuous range of compositions therebetween, is formed. Cast tungsten carbide typically is frozen from the molten state and comminuted to a desired particle size. The last type of tungsten carbide, which has been typically used in hardfacing, matrix bodies, inserts, and cladding, is cemented tungsten carbide, also known as sintered tungsten carbide. Sintered tungsten carbide comprises small particles of tungsten carbide (e.g., 1 to 15 microns) bonded together with cobalt. Sintered tungsten carbide is made by mixing organic wax, tungsten carbide and cobalt powders, pressing the mixed powders to form a green compact, and "sintering" the composite at temperatures near the melting point of cobalt. The resulting dense sintered carbide can then be crushed and comminuted to form particles of sintered tungsten carbide for use in hardfacing, matrix bodies, inserts, and cladding.

Bit bodies formed from either cast or macrocrystalline tungsten carbide or other hard metal matrix materials, while more erosion resistant than steel, lack toughness and strength (relative to steel), thus making them brittle and prone to cracking when subjected to impact and fatigue forces encountered during drilling. This can result in one or more blades breaking off the bit causing a catastrophic premature bit failure. The formation and propagation of cracks in the matrix body may result in the loss of one or more PDC cutters. A lost cutter may abrade against the bit, causing further accelerated bit damage. However, bits formed with sintered tungsten carbide may have sufficient toughness and strength for a particular application, but may lack other mechanical properties, such as erosion resistance. Thus, previous efforts have instead relied on combinations of materials to achieve a balance of properties. Additionally, use of materials having wide particle size distributions have been relied upon so as to achieve a close packing of the carbide wear particles to increase wear resistance.

Accordingly, there exists a need for a new carbide material composition for drill bits or other downhole tool components, which has high strength and toughness, while maintaining other desired properties such as wear and erosion resistance.

SUMMARY OF INVENTION

In one aspect, embodiments disclosed herein relate to a drill bit that includes a bit body having a plurality of blades extending radially therefrom, wherein at least a portion of the bit body comprises a first matrix region comprising a plurality of primary carbide particles having an average mean free path of at least about 10 microns; and at least one cutting element for engaging a formation disposed on at least one of the plurality of blades.

In another aspect, embodiments disclosed herein relate to a drill bit that includes a bit body having a plurality of blades extending radially therefrom, at least a portion of the plurality of blades comprises a first matrix region comprising a plurality of primary carbide particles having a contiguity of less than about 10%; and at least one cutting element for engaging a formation disposed on at least one of the plurality of blades.

In another aspect, embodiments disclosed herein relate to a carbide composite material that includes a first carbide region comprising a plurality of primary carbide particles, each particle having a plurality of buffer particles comprising a plurality of metal particles adhered thereto; and a binder region surrounding the encapsulant layer.

In yet another aspect, embodiments disclosed herein relate to a drill bit that includes a bit body having a plurality of blades extending radially therefrom, wherein at least a portion of the bit body comprises: a first carbide region comprising a plurality of primary carbide particles each particle having a plurality of carbide buffer particles or an encapsulant layer comprising a plurality of metal particles adhered thereto, and a binder region comprising an infiltration binder surrounding the plurality of carbide buffer particles or encapsulant layer; and at least one cutting element for engaging a formation disposed on at least one of the plurality of blades.

In yet another aspect, embodiments disclosed herein relate to a method of forming a carbide body that includes loading a plurality of primary carbide particles having a plurality of buffer particles adhered thereto and a binder material into a mold cavity; and heating the mold contents to form a carbide body.

In yet another aspect, embodiments disclosed herein relate to a method of forming a carbide body that includes loading a plurality of primary carbide particles, a plurality of metal agglomerates, and a binder material into a mold cavity; and heating the mold contents to form a carbide body.

Other aspects and advantages of the invention will be apparent from the following description and the appended claims.

DETAILED DESCRIPTION

Embodiments of the present disclosure provide for matrix compositions suitable for forming bit bodies or other tool components in which its toughness approaches that of steel, while still possessing wear resistance. In addition, embodiments of the present disclosure provide carbide composite bodies (matrix bodies in particular embodiments) which are formed from carbide particles infiltrated by suitable metals or alloys as infiltration binders. In particular, the carbide particles may be provided with means to control the spacing between the carbide particles so that reduced carbide-carbide contact may be achieved as compared to prior art bits. Such a carbide composite body may high strength and toughness while maintaining desired wear and erosion resistance.

The invention is based, in part, on the determination that the life of a matrix bit body is related to the body's strength, toughness, and resistance to wear and erosion. For example, cracks often occur where the cutters (typically polycrystalline diamond compact—"PDC" cutters) are secured to the matrix body, or at the base of the blades. The ability of a matrix bit body to retain the blades is measured in part by its transverse rupture strength. The drill bit is also subjected to varying degrees of impact and fatigue loading while drilling through earthen formations of varying hardness. It is important that the bit possesses adequate toughness to withstand such impact and fatigue loading. Additionally, during drilling processes, drilling fluids, often laden with rock cuttings, can cause erosion of the bit body. Thus, it is also important that the matrix body material be sufficiently erosion resistant to withstand degradation caused by the surrounding erosive environment.

Figure 1:
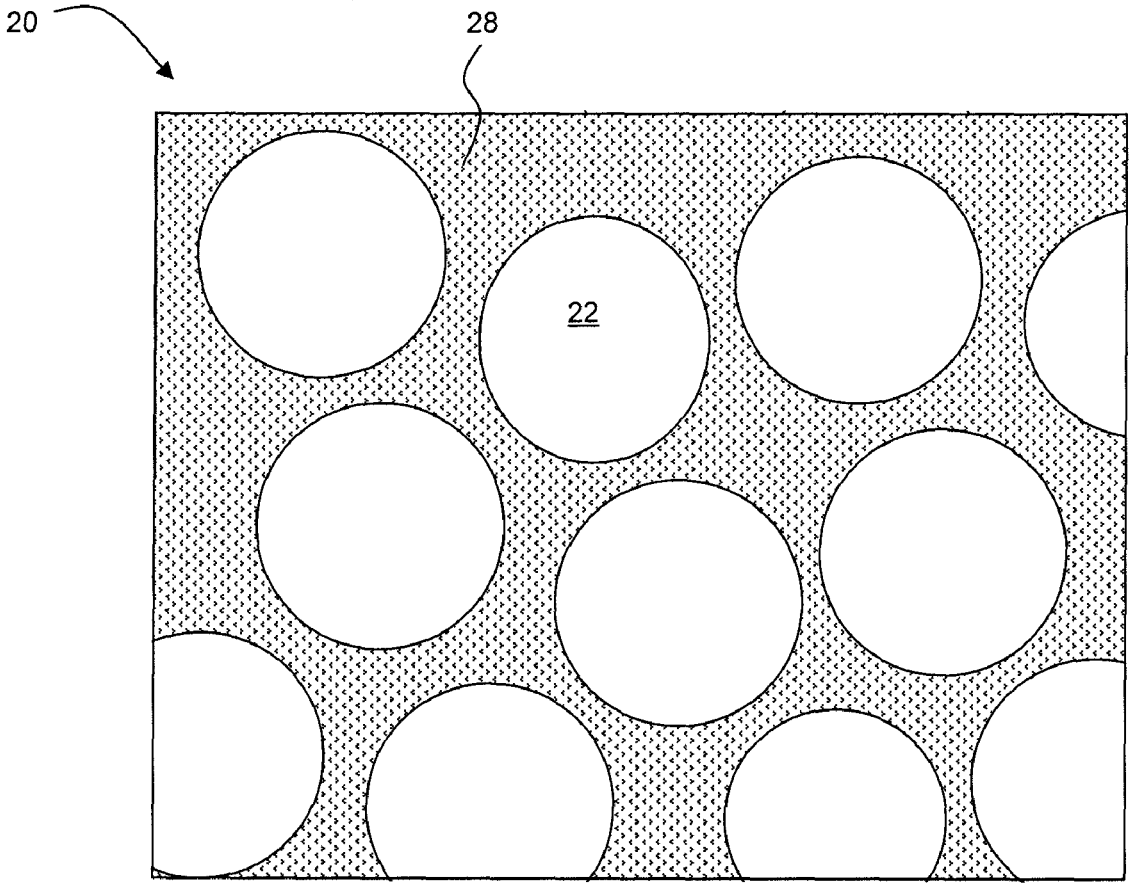
FIG. 1 shows a portioned view of a carbide composite material in accordance with one embodiment.

In particular, while conventional attempts to improve the wear and erosion properties of matrix bit bodies used wide particle size distributions to increase the packing efficiency of the wear resistant carbide particles (by filling smaller carbide particles into the spaces between larger carbide particles resulting in greater carbide-carbide particle contact), the present disclosure is instead directed to techniques for balancing toughness and wear resistance by increasing and controlling the mean free path between primary carbide particles through use of means that provide a buffer zone between adjacent primary carbide particles. Improvements in toughness without sacrificing wear resistance may allow for the extension of the use of the carbide composites disclosed herein to any downhole tool component conventionally formed of steel, but for which greater wear protection may be desired. Use of buffer zones results in greater and more uniform spacing between primary carbide particles, more even distribution of carbide particles throughout the binder phase, less carbide-carbide particle contact, and thus more efficient use of binder phase (i.e., less binder pooling). As used herein, the term "even" distribution simply means that the carbide particles are more uniformly distributed throughout the binder phase when compared with similar prior art samples. Referring to FIG. 1, one embodiment of a carbide body in accordance with the present disclosure is shown. As shown in FIG. 1, the carbide composite material 20 includes a plurality of primary carbide particles 22 dispersed in a matrix of binder 28, whereby the plurality of primary carbide 22 are substantially uniformly distributed in the binder matrix 28.

The relative distribution of carbide particles in the binder phase of the matrix may be measured using several different methods. First, the distribution may be discussed in terms of carbide "contiguity," which is a measure of the number of carbide particles that are in direct contact with other carbide particles. Ideally, if complete distribution existed, the carbide to carbide contiguity would be 0% (i.e., no two carbide particles are in direct contact). Matrix bodies formed in accordance with the matrix powders of the present disclosure may possess a contiguity significantly less than that achieved for a typical matrix body The carbide contiguity may be determined as follows:

$$C_{C\text{-}C}=(2P_{C\text{-}C})/(2P_{C\text{-}C}+P_{C\text{-}M}) \quad \text{(Eq. 1)}$$

where $P_{C\text{-}C}$ equals the total number of contiguous points of carbide along the horizontal lines of a grid placed over a sample photo, and $P_{C\text{-}M}$ equals the total number of points where carbide particles contact matrix. By using the buffer zones disclosed herein, the carbide contiguity may be improved. For example, various embodiments may possess a carbide contiguity of less than about 10%, less than about 5% in other embodiments, and about 0% in yet other embodiments.

Second, the carbide distribution may be discussed in terms of the mean free path, which represents the mean distance between carbide particles. Using this metric, the larger the mean free path (for a given carbide concentration) the more evenly distributed the carbide particles are. In accordance with embodiments of the present disclosure, use of encapsulated particles may provide a means by which the mean free path may be controlled or tailored according to the desired application. That is, the mean free path may depend on the size and type of buffer zone selected. For example, in one embodiment, a minimum mean free path of 10 microns may result from use encapsulated carbides having an encapsulant thickness of 5 microns. However, depending on the type and size of buffer zone, one skilled in the art should appreciate upon learning the teachings of the present invention contained in this application that a much larger mean free path, i.e., approximately 500 microns, may also result. Thus, the mean free path may be a value up to the size of the agglomerates discussed below or at least twice the thickness of the encapsulant layer for a monomodal distribution. However, one skilled in the art should appreciate upon learning the teachings of the present invention contained in this application that the mean free paths would vary slight to less than twice the mean free path when using bi- or otherwise multimodal particle distributions. In a particular embodiment, the mean free path may range from about 25 to 350 microns, from about 50 to 250 microns in another embodiment, and from about 100 to 200 microns in yet another embodiment. Alternatively, other thicknesses, buffer zone sizes, and mean free paths may be selected based on a desired application.

To decrease carbide contiguity and increase mean free path, a better spacing between particles (less efficient packing) is desired. Thus, while conventional wisdom in matrix bit design has indicated that a wide particle size distribution is desirable to fill "pore" spaces between larger carbide particles with smaller carbide particles (increasing packing efficiency) in order increase wear resistance, the present disclosure uses various means to provide a "buffer" zone between adjacent primary carbide particles to result in a greater mean free path and lower packing efficiency. Such less efficient packing is desirable to prevent primary carbide-primary carbide contact. When a bit is subjected to typical loads during drilling, reduction in carbide-carbide contact may result in a bit less prone to cracking (and propagation of cracking).

Figure 2A:
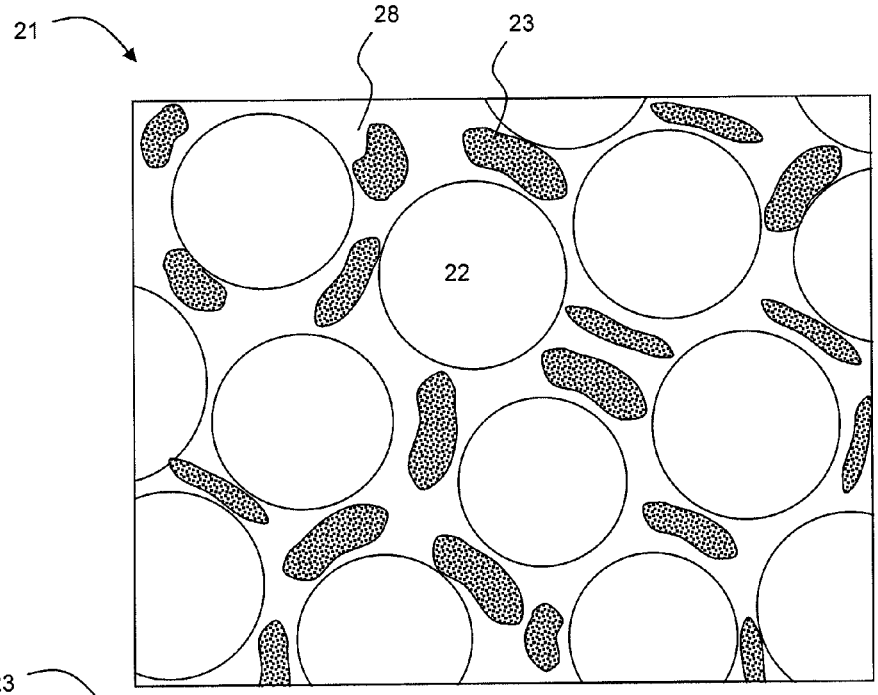
FIG. 2A shows a portioned view of a carbide powder used in accordance with one embodiment.

In one embodiment, a buffer zone resulting in the desired spacing of primary carbide particles may be achieved by use of metal agglomerates (that may optionally contain fine secondary carbide particles) with the primary carbide particles in the matrix powder so that when loaded into a mold cavity, the primary carbide particles have the desired spacing therebetween. Specifically, referring to FIG. 2A, a carbide composite may be formed from a carbide powder 21 that includes a plurality of primary carbide particles 22 mixed with a plurality of metal agglomerates 23. Agglomerates 23 may serve to provide a buffer zone between the adjacent primary carbide particles 22 during the packing of the particles to minimize primary carbide-primary carbide contact.

Figure 2B:
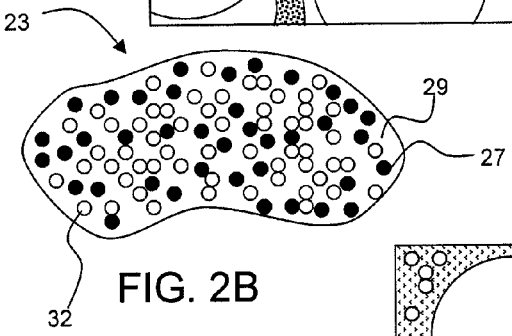
FIG. 2B shows an exploded view of the agglomerates used in the carbide powder shown in FIG. 2A.
Figure 2C:
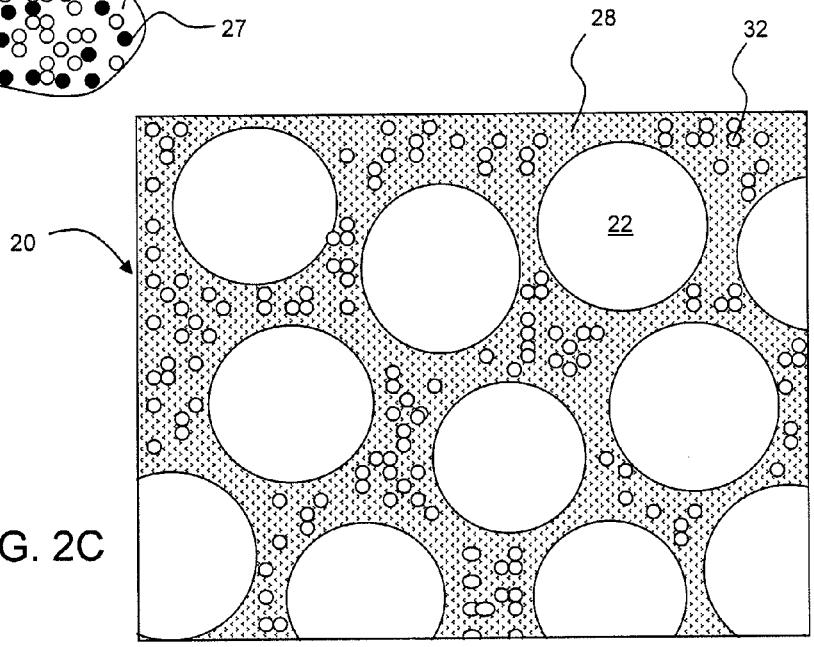
FIG. 2C shows a portioned view of a carbide composite material in accordance with one embodiment.

As shown in FIG. 2B, metal agglomerates 23 may include a plurality of metal particles 27 and a plurality of secondary carbide particles 32; however, in other embodiments, only a plurality of metal particles 27 may be used. The plurality of metal particles 27 and plurality of secondary carbide particles may be held together in agglomerates 23 by an organic binder phase 29. During subsequent introduction to a molten binder, such as an infiltration binder, the agglomerates 23 may break apart, resulting in at least some dispersal of any secondary carbides 32 into the binder phase between the primary carbides 22, and the dissolution of any metal particles 27 (depending on the melting temperature of the metal particles) into the molten binder. Upon cooling, as shown in FIG. 2C, a plurality of primary carbide particles 22 may be dispersed in a matrix of binder 28 that also includes a plurality of secondary carbide particles 32 dispersed therein between the primary carbide particles 22. Further, for embodiments including agglomerates 23 of only metal particles 27, the resulting carbide composite 20 may be more similar to the composite shown in FIG. 1, depending on the dissolution of the metal particles 27 into the binder phase 28.

However, it is also within the scope of the present disclosure that agglomerates 23 may be pre-sintered and/or fully sintered prior to incorporation into the carbide powder 21. In the case of the agglomerates 23 being pre-sintered, the dispersal of the secondary carbide particles 32 into the binder phase 28 may be less than non-pre-sintered agglomerates 23, and in the case of the agglomerates 23 being fully sintered, the agglomerates 23 may retain their shape with no dispersal of the secondary carbides 23 into the binder phase 28, resulting in agglomerates 23 being distributed in the binder phase 28 between primary carbides 22.

The secondary carbide particles that may be used in agglomerates may be substantially smaller in size than the primary carbide particles, with the average size of the secondary carbide particles ranging from 1 to 200 microns, (10-150 microns in other embodiments and 1-25 microns in yet other embodiments), but less than 50 microns in some particular embodiments, and less than 10 microns in yet other embodiments. Further, one skilled in the art should appreciate after learning the teachings of the present invention contained in this application that the size of the secondary carbide particles may depend, in part, on the size of the primary carbide particles (discussed in greater detail below).

Further, for embodiments containing secondary carbide particles in the agglomerates, the carbide may be present in an amount ranging from 50 to 70 weight percent of the total carbide and metal particles. Thus, the agglomerates contain at least 30 weight percent metal particles (of the total carbide and metal particles). The metal particles may include tungsten, titanium, cobalt, nickel, iron, manganese chromium, copper, molybdenum, low carbon steel, and other transition elements and their alloys, and combinations thereof.

The agglomerates may generally range in size (and may be screened to possess such a mesh size) of −60+325 mesh. However, the size of the agglomerates may also depend in part on the size of the primary carbide particles. For example, for a primary carbides having a mesh size of −60+80, the agglomerates may range from −200+325, but for larger primary carbides having a mesh size of −35+45, the agglomerates may also be larger, having a mesh size of −60+200.

Additionally, the relative weight percent of agglomerates that may be mixed with the primary carbides in the carbide powder may depend on the presence/absence of carbide particles, but in a particular embodiment, the agglomerates may from about 15 to 30 weight percent of the matrix powder. However, in other embodiments, more or less may be used depending on the distribution of the agglomerates between the primary carbide particles to ensure adequate spacing therebetween (to minimize primary carbide-primary carbide contact).

The agglomerates may be formed by mixing metal particles (and optionally secondary carbide particles) with an organic binder (such as wax, polyvinyl alcohol, polyvinyl butyral, etc.) in a mixer and then extruding the mixture into smaller pieces and then dried. For example, the mix may be processed through a "granulator" or an agglomerating machine in which the mix is extruded into short "sausage" shapes which may optionally be rolled into other shapes and then dried. Extrusion of the mix may occur using a screen to control the size of the extruded agglomerates. As mentioned above, pre-sintering (or sintering) may optionally occur to melt or soften or fuse at least some of the metal particles together to provide additional strength and cohesiveness to the agglomerates. Pressure may optionally be applied during the pre-sintering or sintering to reduce porosity present in the agglomerates.

Figure 3:
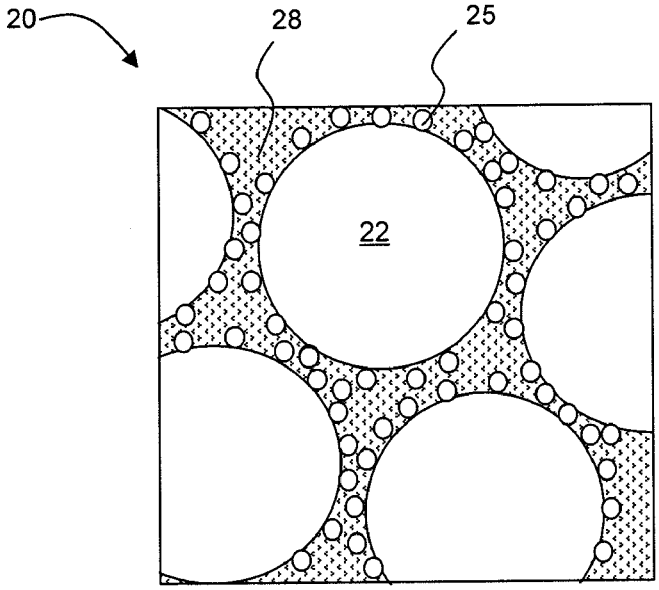
FIG. 3 shows a portioned view of a carbide composite material in accordance with one embodiment.

However, other embodiments of the present disclosure may achieve the desired spacing between the primary carbide particles by providing a plurality of buffer particles adhered to the surface of the primary carbide particle. By adhering such buffer particles to the surface of the primary carbide particles, when the primary carbide particles are packed together, the buffer particles may prevent primary carbide-to-carbide contact. For example, referring to FIG. 3, one embodiment of a carbide body in accordance with the present disclosure is shown. As shown in FIG. 3, the carbide composite material 20 includes a plurality of primary carbide particles 22 dispersed in a matrix of binder 28. Each primary carbide particle 22 includes a plurality of buffer particles 25 adhered thereto.

The plurality of buffer particles 25 may include a plurality of secondary carbide particles and/or a plurality of metal particles. The size of such buffer particles 25 may range up to 50 microns, but may be between 3 and 10 microns in a particular embodiment. Further, similar to as described above, one of ordinary skill in the art should appreciate after learning the teachings of the present invention contained in this application that the size of the buffer particles may depend, in part, on the size of the primary carbide particles and may also depend on the desired spacing between the primary carbide particles.

The buffer particles may be adhered to the surface of the primary carbide particles by providing a glue, such as a polyvinyl alcohol or polyvinyl butyral, to the surfaces of the primary carbide particles (such as by spraying or by mixing) and providing a plurality of buffer particles to be adhered thereto by mixing the two in a turbulent mixer or by ball milling, etc. Thus, once poured into a mold, the primary carbide particles with the buffer particles adhered thereto may pack in with reduced segregation of the primary particles from the fine particles that conventionally occurs in prior art powders by falling of the fine particles between the spaces of the larger particles to the bottom of the mold.

Further, depending on the relative size of the primary carbide particle and the agglomerates discussed above, it is also within the scope of the present disclosure that agglomerates such as those discussed above may be adhered to the surface of the primary carbide particles and serve as the buffer particle. Alternatively, it is also within the scope of the present disclosure that agglomerates (not adhered to the surface of the primary particles) may instead be provided in the matrix powder along with primary particles having a plurality of binder particles adhered thereto.

Additionally, while the embodiment shown in FIG. 3 shows a discontinuous "layer" of particles surrounding the primary carbide particles, certain embodiments of the present invention also relate to using primary carbide particles having a sufficient number of buffer particles adhered thereto to form a substantially continuous "uniform" encapsulant layer thereon. As used herein, an encapsulant layer refers to a surrounding material that is not chemically reacted to the core primary particles, as compared to a "coating" which is chemically bonded to the substrate. As used herein, the term "uniform" means that that individual carbide particles have similar amounts of encapsulating material (i.e., they have relatively the same size), in approximately the same shape (e.g. spherical layer), and that single primary carbide particles are encapsulated rather than carbide clusters or agglomerates. The term "uniform" is not intended to mean that all the particles have the exact same size or exact same amount of encapsulant or that there are not any discontinuities in the encapsulant layer, but simply that when compared to prior art coated particles, they are substantially more uniform. The present inventors have discovered that using carbide particles having a uniform powder encapsulant layer surrounding each primary carbide particle provides a more consistent spacing between the primary carbides in the finished parts. Further, use of such encapsulant layer may provide a greater metal content in the resulting product than prior art bits. Thus, the encapsulated particles may be formed from about 30 to 99 volume percent primary carbide particles and about 70 to 1 volume percent encapsulant. In a particular embodiment, the encapsulated particles may be formed of 60 to 90 volume percent primary carbides and 10 to 40 volume percent encapsulant.

Figure 4:
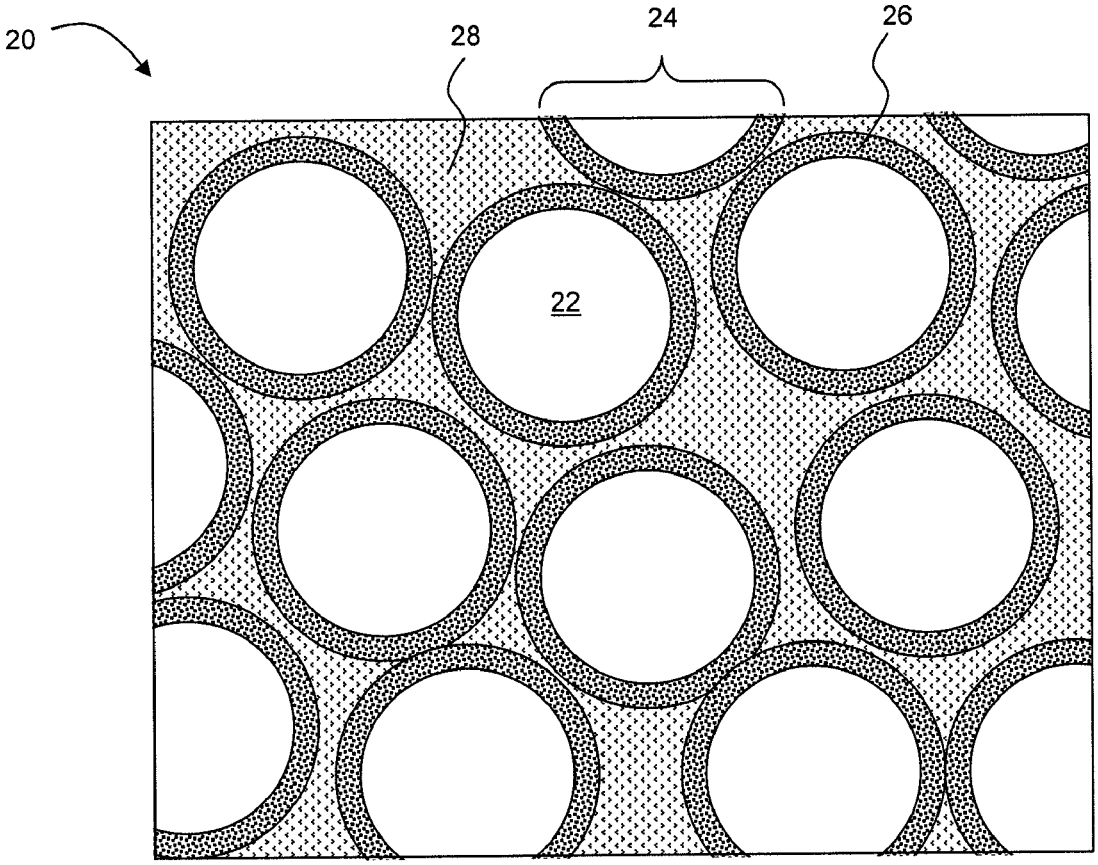
FIG. 4 shows a portioned view of a carbide composite material in accordance with one embodiment.

Referring to FIG. 4, one embodiment of a carbide body in accordance with the present disclosure is shown. As shown in FIG. 4, the carbide composite material 20 includes a plurality of encapsulated particles 24 dispersed in a matrix of binder 28. Each encapsulated particle 24 includes a primary carbide particle 22 surrounded by an encapsulant layer 26. Further, it is also within the scope of the present disclosure that agglomerates, such as those discussed above, may be provided in the carbide powder with the encapsulated particles to be present in the spacing between the encapsulated particles similar to the manner discussed above with respect to FIGS. 2A-2C.

Further, while the pellets (encapsulated particles) may, in some embodiments, be of approximately the same size and shape, the present invention is not so limited. The uniformly encapsulated carbides may comprise other shapes, such as ellipses, rectangles, squares, or non-regular geometries, or mixtures of the shapes, so long as they are approximately the same shape and size. Mixture of the shapes may be used, so long as the layer is thick enough to reduce the amount of carbide to carbide contact. Further, in other embodiments, bi-modal or multi-modal mixtures of pellets may be chosen to increase carbide particle density. In certain embodiments, mixtures of pellet sizes (and encapsulant thicknesses) may be used to allow for higher amounts of carbide particles to be incorporated into the structure, while maintaining suitable carbide contiguity.

Further, carbide particles (and/or pellets) are often measured in a range of mesh sizes, for example −40+80 mesh. The term "mesh" actually refers to the size of the wire mesh used to screen the carbide particles. For example, "40 mesh" indicates a wire mesh screen with forty holes per linear inch, where the holes are defined by the crisscrossing strands of wire in the mesh. The hole size is determined by the number of meshes per inch and the wire size. The mesh sizes referred to herein are standard U.S. mesh sizes. For example, a standard 40 mesh screen has holes such that only particles having a dimension less than 420 μm can pass. Particles having a size larger than 420 μm are retained on a 40 mesh screen and particles smaller than 420 μm pass through the screen. Therefore, the range of sizes of the carbide particles and/or pellets is defined by the largest and smallest grade of mesh used to screen the particles. Carbide particles in the range of −16+40 mesh (i.e., particles are smaller than the 16 mesh screen but larger than the 40 mesh screen) will only contain particles larger than 420 μm and smaller than 1190 μm, whereas particles in the range of −40+80 mesh will only contain particles larger than 180 μm and smaller than 420 μm. Thus, use of mesh screening may allow for an easy determination of particle size distribution. Exemplary mesh sizes for the pellets of the present disclosure may include −230+325, −200+270, −170+230, −140+200, −120+170, −100+140, −80+120, −70+100, −60+80, −50+70, −40+60, −30+40, −20+30, −10+

25, etc. Further, one skilled in the art would appreciate that uniformly sized encapsulated particles may be taken from either end of the size spectrum, including finer or coarser particles. For example, in a particular embodiment, the pellets may have a mean particle size ranging from about 50 to about 840 microns.

Primary Carbide Particles

As mentioned above, various embodiments of the present disclosure may involve plurality of primary carbide particles provided with agglomerates or buffer particles. As used herein, "primary carbide" refers to the center particle which provides the primary wear resistant effect to a later formed matrix bit body. Further, the primary carbide is at least one or two orders of magnitude larger than the secondary particles forming the buffer particles or agglomerates. Such primary carbides may include macrocrystalline tungsten carbide, cast tungsten carbide (spherical or crushed), and sintered tungsten carbide (spherical or crushed). In a particular embodiment, the primary carbide particle may be spherical cast carbide.

As discussed above, one type of tungsten carbide is macrocrystalline carbide. This material is essentially stoichiometric WC in the form of single crystals. Most of the macrocrystalline tungsten carbide is in the form of single crystals, but some bicrystals of WC may form in larger particles. The manufacture of macrocrystalline tungsten carbide is disclosed, for example, in U.S. Pat. Nos. 3,379,503 and 4,834,963, which are herein incorporated by reference.

Another form of tungsten carbide is cemented tungsten carbide (also known as sintered tungsten carbide), which is a material formed by mixing particles of tungsten carbide, typically monotungsten carbide, and cobalt particles, and sintering the mixture. Methods of manufacturing cemented tungsten carbide are disclosed, for example, in U.S. Pat. Nos. 5,541,006 and 6,908,688, which are herein incorporated by reference. Sintered tungsten carbide particles are commercially available in two basic forms: crushed and spherical (or pelletized). Crushed sintered tungsten carbide is produced by crushing sintered components into finer particles, resulting in more irregular and angular shapes, whereas pelletized sintered tungsten carbide is generally rounded or spherical in shape.

Briefly, in a typical process for making cemented tungsten carbide, a tungsten carbide powder having a predetermined size (or within a selected size range) is mixed with a suitable quantity of cobalt, nickel, or other suitable binder. The mixture is typically prepared for sintering by either of two techniques: it may be pressed into solid bodies often referred to as green compacts, or alternatively, the mixture may be formed into granules or pellets such as by pressing through a screen, or tumbling and then screened to obtain more or less uniform pellet size. Such green compacts or pellets are then heated in a controlled atmosphere furnace to a temperature near the melting point of cobalt (or the like) to cause the tungsten carbide particles to be bonded together by the metallic phase. Sintering globules of tungsten carbide specifically yields spherical sintered tungsten carbide. Crushed cemented tungsten carbide may further be formed from the compact bodies or by crushing sintered pellets or by forming irregular shaped solid bodies.

The particle size and quality of the sintered tungsten carbide can be tailored by varying the initial particle size of tungsten carbide and cobalt, controlling the pellet size, adjusting the sintering time and temperature, and/or repeated crushing larger cemented carbides into smaller pieces until a desired size is obtained. In one embodiment, tungsten carbide particles (unsintered) having an average particle size of between about 0.2 μm to about 20 μm are sintered with cobalt to form either spherical or crushed cemented tungsten carbide. In a preferred embodiment, the cemented tungsten carbide is formed from tungsten carbide particles having an average particle size of about 0.8 μm to about 10 μm. In some embodiments, the amount of cobalt present in the cemented tungsten carbide is such that the cemented carbide is comprised of from about 6 to 16 weight percent cobalt. In other embodiments, the cemented tungsten carbide used in the mixture of tungsten carbides to form a matrix bit body may have a hardness ranging from about 90 to 92 Rockwell A.

Cast tungsten carbide is another form of tungsten carbide and has approximately the eutectic composition between bitungsten carbide, $W_2C$, and monotungsten carbide, WC. Cast carbide is typically made by resistance heating tungsten in contact with carbon, and is available in two forms: crushed cast tungsten carbide and spherical cast tungsten carbide. Processes for producing spherical cast carbide particles are described in U.S. Pat. Nos. 4,723,996 and 5,089,182, which are herein incorporated by reference. Briefly, tungsten may be heated in a graphite crucible having a hole through which a resultant eutectic mixture of $W_2C$ and WC may drip. This liquid may be quenched in a bath of oil and may be subsequently comminuted or crushed to a desired particle size to form what is referred to as crushed cast tungsten carbide. Alternatively, a mixture of tungsten and carbon is heated above its melting point into a constantly flowing stream which is poured onto a rotating cooling surface, typically a water-cooled casting cone, pipe, or concave turntable. The molten stream is rapidly cooled on the rotating surface and forms spherical particles of eutectic tungsten carbide, which are referred to as spherical cast tungsten carbide.

The standard eutectic mixture of WC and $W_2C$ is typically about 4.5 weight percent carbon. Cast tungsten carbide commercially used as a matrix powder typically has a hypoeutectic carbon content of about 4 weight percent. Thus, for example, the cast tungsten carbide used in the mixture of tungsten carbides may be comprised of from about 3.7 to about 4.2 weight percent carbon.

Such carbide particles may in the shape of spheres, cubes, irregular shapes, or other shapes, having an aspect ratio of less than 3:1 in some embodiments and less than 1.5:1 in other embodiments. In some embodiments, primary carbide may range in size from 0.04 to 1.0 mm in length or diameter, from 0.075 to 0.5 mm in other embodiments; and from 0.1 to 0.25 mm in yet other embodiments. In other embodiments, the primary carbides (for any of the embodiments disclosed above) may include particles not larger than would be filtered by a screen of 18 mesh. In other embodiments, primary carbide may range in size from −30+325 mesh, from −80+120 mesh in another embodiment, from −60+80 mesh in another embodiment, and from −35+45 mesh in yet another embodiment. Further, one of ordinary skill would recognize that the particle sizes and distribution of the particle sizes of the primary carbide particles may be selected to allow for a broad, uniform, or bimodal distribution, for example, depending on a particular application.

Thus, one skilled in the art would appreciate that the various tungsten carbides disclosed herein may be selected so as to provide a bit that is tailored for a particular drilling application. For example, the type (e.g., cast, cemented, or macrocrystalline tungsten carbide), shape, and/or size of carbide particles used in the formation of a matrix bit body may affect the material properties of the formed bit body, including, for example, fracture toughness, transverse rupture strength, and wear and erosion resistance. In a particular embodiment, either spherical or crushed cast tungsten carbide may be used as the primary carbide in the encapsulated particles of the present disclosure.

Buffer Materials

According to the present disclosure, the desired primary carbide-primary carbide spacing may be achieved by use of various buffer materials described above, including agglomerates, buffer particles, and/or an encapsulant layer. As described above, buffer particles and an encapsulant layer refer to a "layer" (discontinuous or substantially continuous) of particles that is provided on a primary carbide without chemical bonds to the underlying particle. The agglomerates and the buffer particles provided with the primary carbide particles may include a blend of metal and/or fine, secondary carbide particles. Secondary carbides may include at least one of macrocrystalline tungsten carbide particles, carburized tungsten carbide particles, cast tungsten carbide particles, and sintered tungsten carbide particles. In other embodiments, non-tungsten carbides of vanadium, chromium, titanium, tantalum, niobium, and other carbides of the transition metal group may be used, as well as oxides, and nitrides of Group IVA, VA, or VIA metals may be used. Particle sizes of the secondary carbide particles may range, in particular embodiments from 3 to 75 microns, and less than 50 microns in other embodiments. However, in other embodiments, other ranges, including those described above, may be used. Additionally, buffer materials may alternatively include tungsten, titanium, cobalt, nickel, iron, manganese chromium, copper, molybdenum, low carbon steel, and other transition elements and their alloys, and combinations thereof. Selection between such metals may be dependent on such factors as type of application, avoidance of eta phase formation with primary carbide, melting points, etc. Similar size ranges as the secondary carbide particles may be used for the metal particles present in the buffer materials.

In a particular embodiment, the encapsulant layer may be selected to have a melting point greater than the infiltration binder described below. Thus, in such an embodiment, when forming the matrix bit body, the encapsulant layer remains surrounding the primary carbide particles during infiltration defining a distinct surrounding region, to maintain the improved mean free path between the carbide particles in the final product. However, in other embodiments, some portions of the encapsulant layer (i.e., the metal powder) may have a melting point below that of the infiltration binder described below and the molten infiltration binder may melt at least some portion of the encapsulant layer, resulting in a less defined encapsulant layer or dissolution of any encapsulant layer in the finished product. Additionally, it is also within the scope of the present disclosure that even a uniform encapsulant layer may have some discontinuities or pores present in the layer that may allow the molten infiltration binder to infiltrate into the encapsulant layer during infiltration.

The use of buffer materials including the encapsulant layer results in difference in chemical makeup may translate, for example, into a difference in wear or erosion resistance properties, as well as toughness. One of ordinary skill in the art would recognize that the wear properties of the primary carbide relative to the encapsulant layer, as well both the primary carbide and encapsulant layer relative to surrounding infiltrating binder may be tailored by changing their respective chemical makeup. Thus, for example, during drilling, an applied load may be transferred from the primary carbide particles to the surrounding, tougher, encapsulant shell to reduce the incidence of carbide particles breaking off.

Thus, the encapsulant layer may consist of a mixture of a carbide compound and/or a metal alloy using any technique known to those skilled in the art. A desirable layer thickness may vary depending on a variety of factors including type of encapsulant, type, size of primary carbide being used, and resulting properties desired. In some embodiments, the encapsulant layer may have an average thickness ranging from 5 to 250 microns. For example, for a layer solely comprised of metal particles, the layer thickness may range from 5 to 50 microns, whereas a layer comprising both metal particles and secondary carbide particles may range in thickness up to 250 microns, preferably 50 to 100 microns.

Prior art coatings on carbide particles, to the extent that they were known, involve chemical vapor deposition (CVD) or electroplating, typically BN, WC, $Al_2O_3$, in which a material is deposited on the carbide particles in a thickness of less than a few micrometers as a coating, i.e., chemically bonded to the substrate. This is in contrast to the present disclosure, in which non-bonded encapsulants of typically greater than 5 or 10 micrometers are used. In certain embodiments, thicknesses of approximately up to 250 micrometers may be used. Further, while certain embodiments may use a "uniform" encapsulant matrix material, in alternative embodiments, the thickness and chemical composition of the encapsulant layer may be tailored to achieve a desirable wear/erosion resistance and/or strength and toughness.

Uniformly encapsulated primary carbides may be manufactured prior to the formation of the bit body. An exemplary method for achieving "uniform encapsulation" is to mix the primary carbide particles, encapsulant matrix powder and an organic binder (such as those described above) in a commercial mixing machine such as a Turbula Mixer or similar machine used for blending particles with matrix. The resultant mix may then be processed through a "granulator" in which the mix is extruded into short "sausage" shapes which are then rolled into balls and dried. The granules that are so formed must be separated using a series of mesh screens in order to obtain the desired yield of uniformly encapsulated particles. At the end of this process, a number of particles of approximately the same size and shape can be collected. Another exemplary method for achieving a uniform matrix layer on the carbide particles is to use a machine called a Fuji Paudal pelletizing machine. The encapsulated carbides may then be transferred into a mold cavity and used in forming a matrix bit body, such as by infiltration with an infiltrating binder.

Binder Phase

Thus, in a formed bit body (or any other formed carbide composite), the primary tungsten carbide particles may be immediately surrounded by the buffer particles, encapsulant materials, and/or have agglomerates distributed therein, which are then surrounded by a binder phase, such as an infiltration binder. The term "infiltration binder" herein refers to a metal or an alloy used in an infiltration process to bond the various particles of tungsten carbide (or in this instance encapsulated particles) forms together. Suitable metals include all transition metals, main group metals and alloys thereof. For example, copper, nickel, iron, and cobalt may be used as the major constituents in the infiltration binder. Other elements, such as aluminum, manganese, chromium, zinc, tin, silicon, silver, boron, and lead, may also be present in the infiltration binder. In one preferred embodiment, the infiltration binder is selected from at least one of nickel, copper, and alloys thereof. In another preferred embodiment, the infiltration binder includes a Cu—Mn—Ni—Zn alloy.

By using matrix powders of the present disclosure, once infiltrated to form a matrix body (or region), the final infiltrant content of the matrix region may range from about 5 to 50 percent by volume and from 10 to 45 percent by volume in another embodiment. However, the total metal content includes both the infiltrant and the metal contained in the encapsulated layer. Thus, the total metal content may range, for example, from about 30 to 50 volume percent. Further, such carbide contents may range from about 40 to 75 volume percent, and encapsulant contents, from about 1 to 35 volume percent. However, these percentages may be varied by altering the particle size of the carbide particles, the carbide content, and by the desired buffer particle or encapsulant thickness or inclusion of agglomerates (for example, in embodiment using buffer particles adhered to the surface of the primary carbides). An alternatively way of expressing the binder content may be by looking at the area fraction, which, may be estimated, for example, from SEM microscopy of a resulting matrix body. Further, with a sufficient number of cross-sections, the volume fraction may be estimated from the area fraction.

The matrix body material in accordance with embodiments of the invention has many applications. Generally, the matrix body material may be used to fabricate the body for any earth-boring bit which holds a cutter or a cutting element in place. Earth-boring bits that may be formed from the matrix bodies disclosed herein include PDC drag bits, diamond coring bits, impregnated diamond bits, etc. These earth-boring bits may be used to drill a wellbore by contacting the bits with an earthen formation.

Figure 5A:
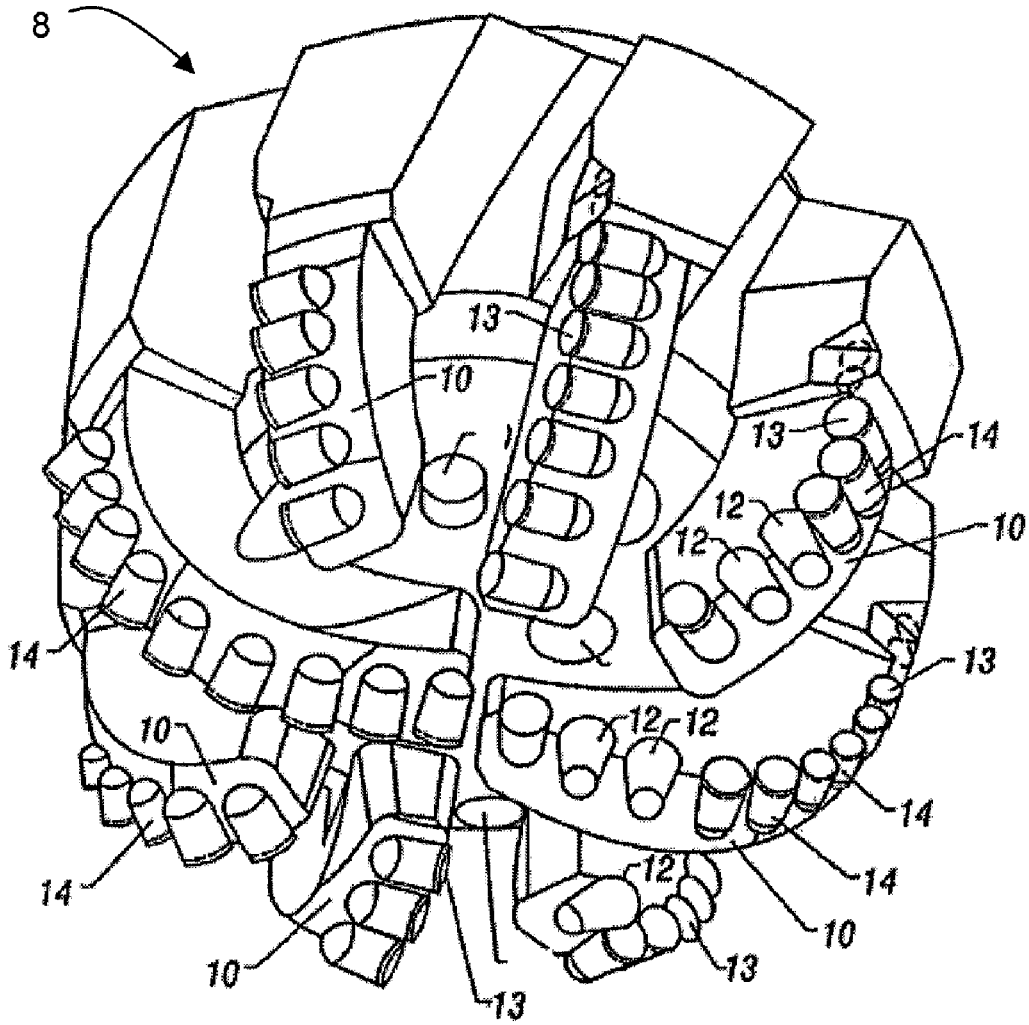
FIG. 5A is a perspective view of an earth boring PDC drill bit body with some cutters in place according to an embodiment.
Figure 5B:
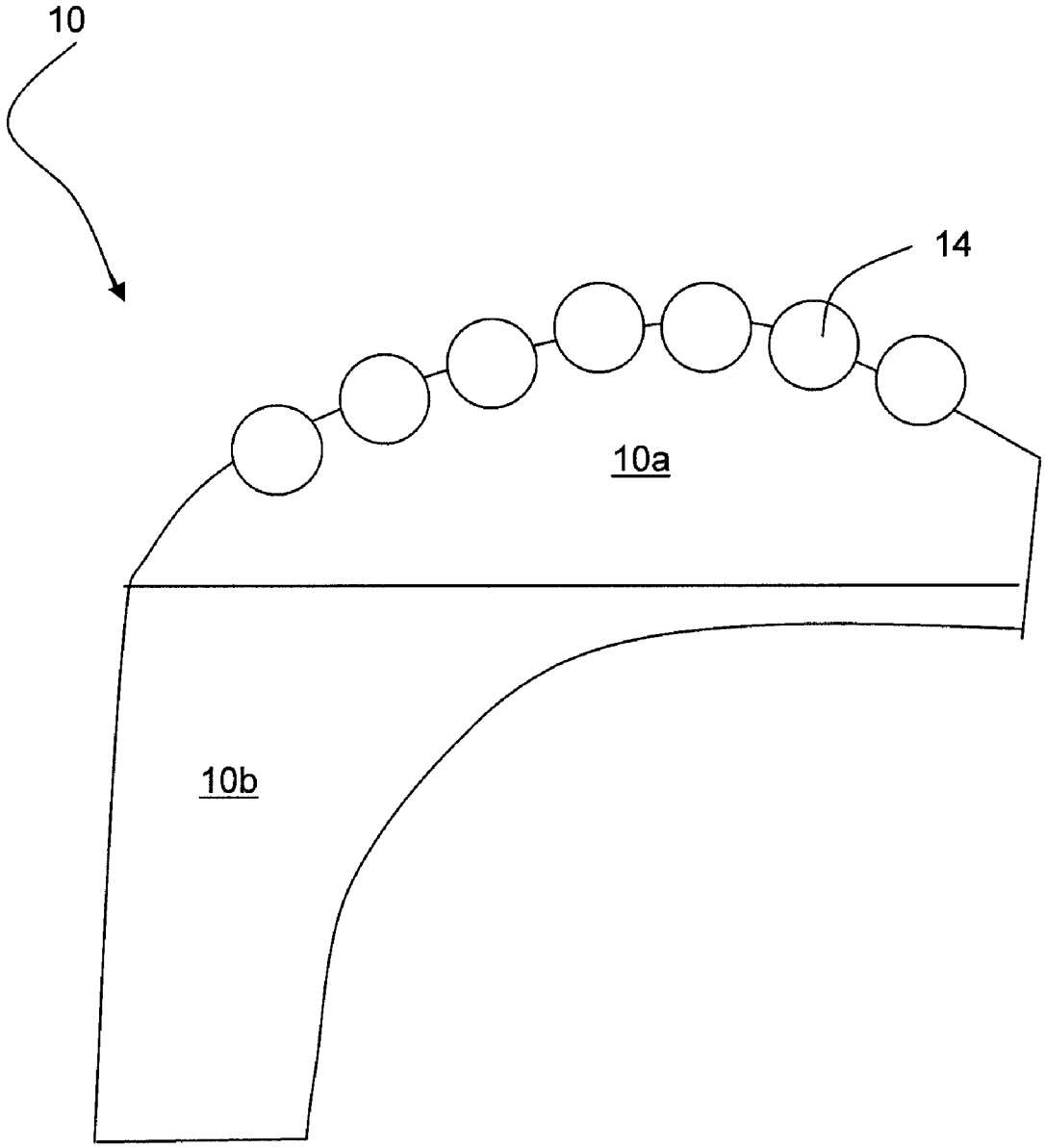
FIG. 5B shows a cross-sectional view of a blade in accordance with one embodiment.

A PDC drag bit body manufactured according to one embodiment of the present disclosure is illustrated in FIG. 5A-5B. Referring to FIG. 5A, a PDC drag bit body 8 is formed with blades 10 at its lower end. A plurality of recesses or pockets 12 are formed in the faces to receive a plurality of conventional polycrystalline diamond compact cutters 14. The PDC cutters, typically cylindrical in shape, are made from a hard material such as tungsten carbide and have a polycrystalline diamond layer covering the cutting face 13. The PDC cutters are brazed into the pockets after the bit body has been made.

Methods of making matrix bit bodies are known in the art and are disclosed for example in U.S. Pat. No. 6,287,360, which is assigned to the assignee of the present invention. These patents are hereby incorporated by reference. Briefly, infiltration processes that may be used to form a matrix bit body of the present disclosure may begin with the fabrication of a mold, having the desired body shape and component configuration. Matrix powder having an amount of the primary carbide particles with buffer materials may be loaded into the mold in the desired location, i.e., blades, and the mass of particles may be infiltrated with a molten infiltration binder and cooled to form a bit body. Alternatively, a second matrix powder, including for example non-encapsulated particles or primary particles without any type of buffer material may be loaded onto the first matrix powder, such that a bit body (or blade, as shown in FIG. 5B) may be generally divided into two matrix regions: a first matrix region 10*a* formed with buffer zones (thus forming a low contiguity matrix region) and a second matrix region 10*b* formed without buffer zones. In the embodiment shown, the first matrix region 10*a* forms a portion of the outer cutting portion of the blade, whereas the second matrix region 10*b* is layered thereon to form a portion of the base (and gage) of the blade. However, there is no limitation on the number of or manner in which the layers may be provided in forming the bit.

Further, while the above disclosure may focus its description on the use of such carbides in forming a matrix bit body, the present invention is not so limited. Rather, it is specifically within the scope of the present disclosure that carbide bodies which result from use of encapsulated carbides as disclosure herein may constitute any downhole tool or component, including structures that may have been formed from carbides as well as those conventionally formed from steel due to the improved toughness values relative to most carbide composites. Thus, the carbide bodies shown in FIG. 1-4 above, may form at least a portion of bit body (blade top, nozzle area, etc., a cutting element (TCI (including gage insert) or PDC substrate), hardfacing, downhole tool sleeve (which is welded to a bit), reamer, stabilizer, hole opener, and roller cone, etc. Further, one skilled in the art would appreciate that in such cases, the binder surrounding the encapsulated particles may be selected depending on the particular application and manufacturing/formation processes (i.e., welding tube for hardfacing, non-"infiltrant" binder for cutting elements/inserts, casting, cladding, etc.)

Exemplary Compositions

Various examples of different formulations of encapsulated particles having different carbide content, carbide particle size, and encapsulant thickness is shown in Table 1 below. The resulting fraction contents are also shown.

TABLE 1

| Main Carbide microns | Encapsulated Layer microns | Main Carbide area % | Encapsulated Layer area % | Metal area % |
|---|---|---|---|---|
| 50 | 5 | 50 | 15 | 35 |
| 50 | 5 | 70 | 21 | 9 |
| 50 | 10 | 50 | 24 | 26 |
| 50 | 10 | 60 | 29 | 11 |
| 150 | 5 | 50 | 6 | 44 |
| 150 | 5 | 70 | 8 | 22 |
| 150 | 20 | 50 | 19 | 31 |
| 150 | 20 | 70 | 26 | 4 |
| 420 | 10 | 50 | 4 | 46 |
| 840 | 5 | 50 | 1 | 49 |
| 840 | 5 | 70 | 2 | 28 |
| 840 | 250 | 50 | 30 | 20 |

Additionally, while the formulations in Table 1 include monomodal distributions of encapsulated particles, it is also within the scope of the present disclosure that multimodal distributions of encapsulated particles be used. For example, shown in Table 2a and 2b below are two example formulations of trimodal distributions and the resulting fraction contents.

TABLE 2a

| | Main Carbide microns | Encapsulated Layer microns | Main Carbide area % | Encapsulated Layer area % | Metal area % |
|---|---|---|---|---|---|
| | 840 | 5 | 40 | 0.9 | |
| | 420 | 10 | 15 | 1.3 | |
| | 50 | 5 | 5 | 1.5 | |
| Total | | | 60 | 3.8 | 36.2 |

TABLE 2b

| | Main Carbide microns | Encapsulated Layer microns | Main Carbide area % | Encapsulated Layer area % | Metal area % |
|---|---|---|---|---|---|
| | 840 | 5 | 50 | 1.2 | |
| | 420 | 10 | 25 | 2.2 | |
| | 50 | 5 | 10 | 3.1 | |
| Total | | | 85 | 6.4 | 8.6 |

Selection of the particle size, carbide content, encapsulant thickness, and particle distribution may be selected based on the desired application. For example, larger carbides may be preferred for maximum erosion resistance (resulting from particles being anchored in to the carbide body), while finer carbides may be preferred for maximum strength and toughness, whereas a medium carbide size may strike a balance between the two properties. Multimodal distributions (bimodal or tri-modal) may allow for increased packing of the carbides (and decreased infiltrant contents), which could not be otherwise used (due to lack of toughness), without use of the encapsulated layer to provide crack arresting properties.

Embodiments of the present disclosure may provide at least one of the following advantages. The use of encapsulated tungsten carbide particles may allow for reduce carbide-carbide contact, a larger mean free path, and thus yielding a more efficient use of binder. Further, the weight percentage binder may be more predictable and repeatable using such matrix powders, increasing toughness without sacrificing wear properties. Such increase in toughness is also thought to result from the metal binder powder content as well. Moreover, as some porosity in the encapsulating layer may exist, during infiltration, the infiltration binder may seep, to some extent, into those pores, increasing the adhesion of the primary carbides to the carbide body.

Thus, advantageously, certain embodiments of the present invention, by creating matrix bodies having more uniform distribution of primary carbide particles results in products having more uniform wear properties, improved toughness, improved carbide retention, and reduced tendency for crack propagation, when compared to prior art structures. Such improved toughness values may allow for use of these particles to form structures which have conventionally been formed from steel due to toughness requirements for the structure. Thus, by extending the use of matrix compositions to form such conventionally steel structures, greater wear resistance may also be achieved for those structures generally formed without inherent wear resistance (and thus sometimes requiring wear protection such as hardfacing). In addition to possessing better wear resistance, such structures may also possess greater repairability (as discussed below).

Due to such a reduced tendency for crack propagation, repairability of the bit bodies may improve. For example, due to the improved toughness properties, even if a small crack exists in the bit body, the bit may be sent back to the field because of low risk of crack propagation. Greater ease in repairability of bit bodies may also rest in the ability to better patch the encapsulated particles, through welding, brazing or spraying methods used, which results from improved adhesion due in part to the shielding of carbide particles. Further, because of such better adhesion properties, particles may be attached by welding during repair, which may reduce the bit exposure temperatures by as much as 100° C. or more, because localized heating rather than heating of the entire bit may be used. By avoiding heating the entire bit and reducing exposure temperatures, residual stresses caused during bit heating may be decreased during rebuild.

Thus, by using the matrix powders of the present disclosure, the resulting matrix body (or region) may be advantageously characterized as possessing toughness and strength without impairing wear and erosion resistance, and thus not susceptible to cracking and wear/erosion. These advantages may lead to improved bit bodies for PDC drill bits and other earth-boring devices or downhole components in terms of longer bit or tool life.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A drill bit, comprising:

a bit body having a plurality of blades extending radially therefrom, wherein at least a portion of the bit body comprises a first matrix region comprising a plurality of primary carbide particles having an average mean free path of at least about 10 microns; and at least one cutting element for engaging a formation disposed on at least one of the plurality of blades.

2. The drill bit of claim 1, wherein the plurality of primary carbide particles are surrounded by a plurality of buffer particles.

3. The drill bit of claim 2, wherein the buffer particles comprises at least one of a plurality of metal particles or a plurality of secondary carbide particles.

4. The drill bit of claim 3, wherein the plurality of primary carbide particles are surrounded by an encapsulant layer.

5. The drill bit of claim 3, wherein the encapsulant layer has a thickness of at least 5 microns.

6. The drill bit of claim 3, wherein the plurality of metal particles have a melting point greater than an infiltration binder.

7. The drill bit of claim 1, wherein the primary carbide particles comprise at least one of cast tungsten carbide, sintered tungsten carbide, and macrocrystalline tungsten carbide.

8. The drill bit of claim 7, wherein the primary carbide particles comprise spherical cast tungsten carbide.

9. The drill bit of claim 1, wherein a plurality of agglomerates are dispersed between the plurality of primary carbide particles, and wherein the plurality of agglomerates comprise a plurality of secondary carbide particles and a plurality of metal particles.

10. A drill bit, comprising:

a bit body having a plurality of blades extending radially therefrom, at least a portion of the plurality of blades comprises a first matrix region comprising a plurality of primary carbide particles having a contiguity of less than about 10%; and at least one cutting element for engaging a formation disposed on at least one of the plurality of blades.

11. The drill bit of claim 10, wherein the plurality of carbide particles have a contiguity of less than about 5%.

12. The drill bit of claim 11, wherein the plurality of carbide particles have a contiguity of about 0%.

13. The drill bit of claim 10, wherein the plurality of primary carbide particles are surrounded by a plurality of buffer particles.

14. The drill bit of claim 13, wherein the buffer particles comprises at least one of a plurality of metal particles or a plurality of secondary carbide particles.

15. The drill bit of claim 14, wherein the plurality of primary carbide particles are surrounded by an encapsulant layer.

16. The drill bit of claim 15, wherein the encapsulant layer has a thickness of at least 5 microns.

17. A drill bit, comprising:

a bit body having a plurality of blades extending radially therefrom, wherein at least a portion of the bit body comprises:

a first carbide region comprising a plurality of primary carbide particles each particle having a plurality of carbide buffer particles or an encapsulant layer comprising a plurality of metal particles adhered thereto, and a binder region comprising an infiltration binder surrounding the plurality of carbide buffer particles or encapsulant layer; and at least one cutting element for engaging a formation disposed on at least one of the plurality of blades.

18. The drill bit of claim 17, wherein the encapsulant layer further comprises a plurality of secondary carbide particles.

19. The drill bit of claim 17, wherein the encapsulant layer has a thickness of at least 5 microns.

20. The drill bit of claim 17, wherein the primary carbide particles comprise at least one of cast tungsten carbide, sintered tungsten carbide, and macrocrystalline tungsten carbide.

21. The drill bit of claim 20, wherein the primary carbide particles comprises spherical cast tungsten carbide.

22. The drill bit of claim 17, wherein the plurality of metal binder particles have a melting point greater than the infiltration binder.

* * * * *